United States Patent [19]

Brentham

[11] 4,185,818

[45] Jan. 29, 1980

[54] FLUID RESISTANCE TYPE LEG EXERCISER

[76] Inventor: Jerry D. Brentham, 102 Elm Dr., Belton, Tex. 76513

[21] Appl. No.: 790,051

[22] Filed: Apr. 22, 1977

[51] Int. Cl.[2] ..... A63B 21/00

[52] U.S. Cl. ..... 272/130; 272/134

[58] Field of Search ..... 272/130, 116, 131, 142, 272/144, 146, DIG. 4, 136, 134; 128/31, 361; 269/324, 328

[56] References Cited

U.S. PATENT DOCUMENTS

| | | | |
|---|---|---|---|
| 552,971 | 1/1896 | Sandow | 272/136 X |
| 1,902,694 | 3/1933 | Edwards | 272/144 X |
| 2,067,891 | 1/1937 | Comper | 269/328 |
| 3,471,145 | 10/1969 | Berger | 272/130 |
| 3,756,595 | 9/1973 | Hague | 272/130 X |
| 4,022,463 | 5/1977 | Scott | 272/136 |
| 4,034,972 | 7/1977 | Peterson | 269/324 |

FOREIGN PATENT DOCUMENTS

| | | | |
|---|---|---|---|
| 1805628 | 5/1970 | Fed. Rep. of Germany | 272/142 |

*Primary Examiner*—Richard C. Pinkham
*Assistant Examiner*—Browne William R.
*Attorney, Agent, or Firm*—Gerald G. Crutsinger

[57] ABSTRACT

A leg exercising device adapted to strengthen hip abduction and adduction muscles comprising body support members secured to a frame to support the human body such that the median axis of the human body is substantially parallel to the central axis of the body support members. A pair of padded leg support members, adapted to engage the side of the legs, and a fluid flow resistence member are secured to the body support members to resist movement of extremities of the leg support members in a lateral direction between a first position wherein the feet of a user are adjacent the median axis of the body of the user to a second position wherein the extremities of the leg support members are spaced from the median axis of the body. The body support members comprise a back portion, having an upper and lower end, and a seat portion, having an upper and lower end; the back and seat portions being positioned such that the lower ends of the back and seat portions are adjacent each other and such that the angle between upper surfaces of the back and seat portions are 90 degrees or greater, so as to support the legs in a slightly bent position.

11 Claims, 8 Drawing Figures

FLUID RESISTANCE TYPE LEG EXERCISER

BACKGROUND

Most exercising devices serve two purposes, to strengthen muscles and to rehabilitate muscles which have been damaged.

In contact and running sports, the knee is probably the most damaged portion of the body. It is important to strenghten the muscles in the hip, thigh and calf to prevent injury to muscles in these areas, and to assure proper rehabilitation of damaged muscles. Proper strengthening of these muscles in the hip, thigh and calf areas will prevent undue stress on the knee connecting tissue which is easily damaged.

Heretofore, exercising devices have not utilized the full potential of stressing muscles throughout movement of a limb to fully strengthen adductor and abductor muscles of the hip. Strengthening the hip muscles and thigh muscles is extremely important in knee rehabilitation because any weak portion of the lower muscular system might result in reinjury of the previously damaged knee or other muscle.

For the most efficient strengthening of these areas, it is necessary to isolate these muscles and restrain the rest of the body movement. In addition, it is important to position the body in an attitude similar to that in which the muscles will be doing their work. For example, most of the work done by muscles in the leg of an athletic is done while the leg is slightly bent at the knee and hip. Therefore, it is important to position the body such that the legs extend outwardly from the hip in a slightly bent position and the legs slightly bent at the knee to strengthen the muscles in the position that they are used.

SUMMARY OF THE INVENTION

I have devised a leg exercising device for strengthening the hip abduction and adduction muscles along with the ham string muscles of the thigh. The device generally comprises a frame having a central axis with body support members on the frame adapted to support the human body in such a position that the median axis of the human body, an axis substantially parallel to the spine, is parallel to the central axis of the body support members. A pair of leg pads, comprising substantially U-shaped members having padding thereon, are connected to fluid flow resistant means by connector means such as outwardly extending leg support members. The pads are adapted to engage the side of the leg. Preferably, a thigh pad is positioned on the leg support members to engage the thigh just above the knee to resist lateral movement of the thigh, and an ankle pad is positioned on the leg support members to engage the side of the ankle to resist lateral movement of the ankle. Movement is resisted between a positon wherein the thigh or ankle pad is adjacent the central axis of the body support members and a position spaced away from the central axis of the body support members in a generally horizontal or lateral direction.

The fluid flow resistance means generally comprises a hollow cylindrical having a piston slideably disposed in the cylinder chamber and a piston rod secured to the leg support member connected between the piston and the pad. Fluid is disposed on each side of the piston such that the fluid must flow through a control valve thus controlling the rate of flow and resisting movement of the piston within the cylinder chamber and thereby resisting movement of the pad connected to the piston by a connector means.

The body support members comprise a back portion and a seat portion, each having upper and lower ends. The lower ends of the back portion and the seat portion are positioned ajacent each other such that the angle between the upper surfaces of the back portion and seat portion is between 90 and 180 degrees such that the body is positioned with the legs slightly bent at the hip.

It is preferable that the thigh pad and ankle pad be positioned such that the leg will be in a slightly bent position such that the muscles of the hip and leg will be stressed when the leg is in the working position which is slightly bent at the knee.

By exerting pressure against the ankle pad by the leg of the user in attempting to move the ankle pad outwardly from the median axis of the body, the user stresses the medial and lateral ham string muscles in the calf. By applying pressure against the thigh pad in a lateral position to move the thigh pad outwardly from the median axis of the body, the user strengthens and stresses and adduction and abduction muscles in the hip.

In addition hand grips are provided to extend outwardly from the back portion of the body support member to aid in restraining the upper body from movement which would aid the movement of the legs.

A primary object of the invention is to provide an exercising device which isolates the leg muscles to efficiently strengthen the leg muscles.

Another object of the invention is to stress medial and lateral ham string muscles by applying pressure against an ankle pad in a lateral direction to move the ankle relative to the median axis of the body.

A further object of the invention is to strengthen the abduction and adduction muscles of the hip by applying pressure with these muscles against one or more thigh pad, located just above the knee, in attempting to move the thigh pads away from the median axis of the body and back again while such movement is resisted.

A further object of the invention is to position the body of a user in a position oriented similar to the position in which it would naturally be positioned to perform work.

Other and further objects of the invention will become apparent upon referring to the detailed description hereinafter following and to the drawings annexed hereto.

DESCRIPTION OF THE DRAWINGS

Drawings of a preferred embodiment of the invention have been annexed hereto, so that the invention will be more fully understood, in which.

Numeral references are employed to designate like parts throughout the various figures of the drawings.

DESCRIPTION OF A PREFERRED EMBODIMENT

Figure 3:
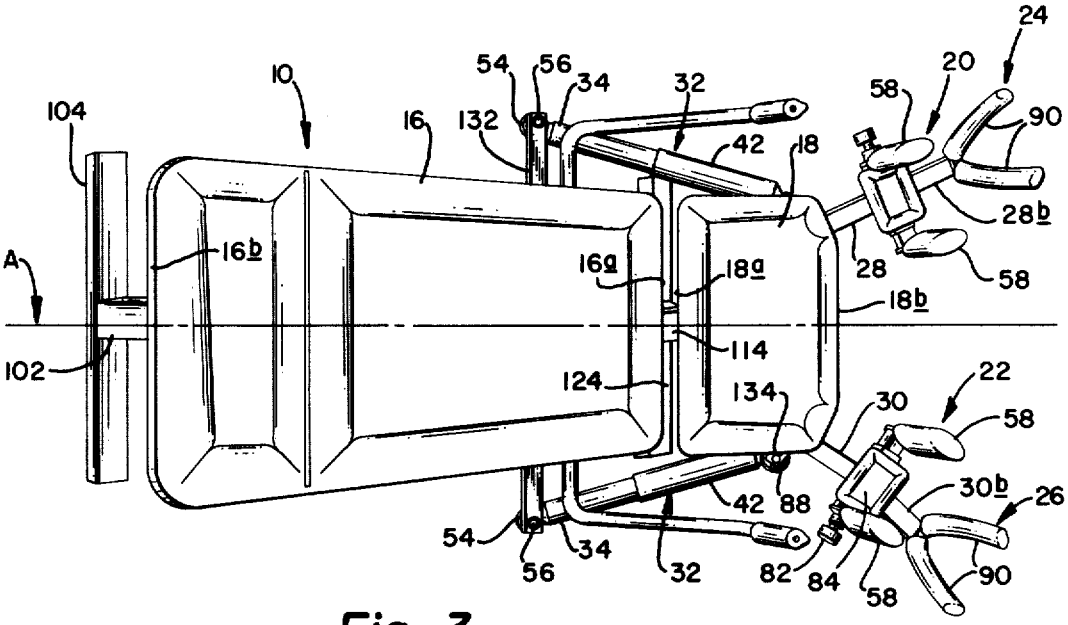
FIG. 3 is a top plan perspective view thereof.
Figure 4:
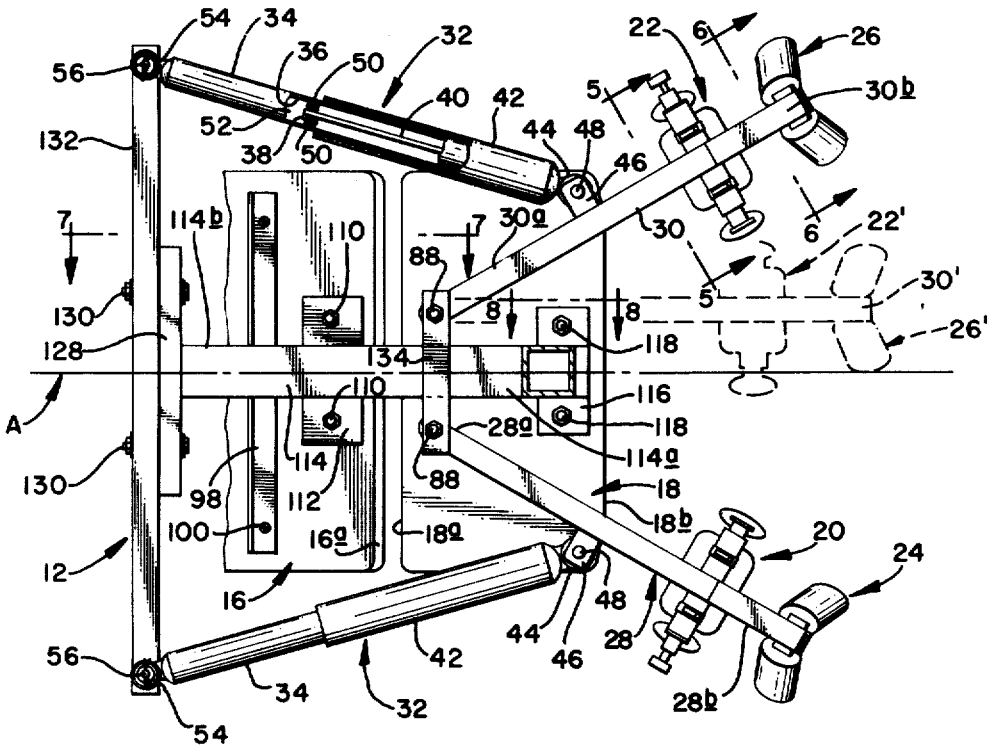
FIG. 4 is an enlarged bottom plan view of the leg support and fluid resistant cylinder with parts broken away to more clearly illustrate the details of construction.

A leg exercising device 10, adapted to strengthen the hip abduction and adduction muscles, generally comprises a frame 12 having a central axis A, as illustrated in FIGS. 3 and 4. Frame 12 has body support members 16 and 18 secured thereto to support the human body such that the median axis of the body, which generally passes through the body substantially parallel to the spinal column of the human body, is parallel to the central axis A of body support members 16 and 18 and frame 12.

A pair of leg pads 20 and 22 and ankle pads 24 and 26 are pivotally secured by connecting means such as leg support members 28 and 30 to the frame 12, as will be more fully explained hereinafter.

Leg support members 28 and 30 are secured to a first end of a pair of fluid flow resistant means 32. The second end of the pair of fluid flow resistant means 32 is anchored to the frame 12 such that movement of the leg pads 20 and 22 and leg support members is resisted from a position substantially parallel and adjacent to the central axis A of the frame 12, shown in dashed outline in FIG. 4, to a position wherein the extremities of the pads 22 and 20 and leg support members 28 and 30 are spaced from the median axis of the body and the central axis A of the frame 12.

The fluid flow resistant means 32, illustrated in the preferred embodiment, comprise two-way resistive cylinders such as standard motorcycle racing shock absorbers. The fluid flow resistant means 32 generally comprises a cylinder 34 having a hollow bore 36 which defines a chamber 52 with a piston 38 slideably disposed therethrough. The piston 38 is connected to a connecting rod 40 which is secured to an end housing 42 which is slideably disposed over the exterior of cylinder 34. Housing 42 has a bushing 44 rigidly secured to the end thereof which is secured in clevis 46 by a pin 48 to leg support members 28 and 30 and to the leg pads 20 and 22. Piston 38 has pressure resistant check valves 50 for controlling the flow of fluid from a first end of chamber 52 on one side of piston 38 to a second end of chamber 52 on the other side of piston 38. Fluid such as hydraulic oil, silicone or the like is placed in chamber 52 of cylinder 34 such that movement of the rod 40 and piston 38 is resisted by the rate of flow of fluid through the check valve 50. The end of cylinder 34 has a bushing 54 rigidly secured thereto which is secured to the frame 12 by pin 56.

It should be readily apparent that movement of pads 20 and 22 is resisted from a position, shown in dashed outline as indicated by 22', substantially aligned with the central axis A of the frame to a position spaced from the central axis A of the frame 12. Fluid movement is resisted in both directions in chamber 52 such that movement of pads 20 and 22 and leg support members 28 and 30 is also resisted from the position spaced from the central axis A of the frame shown in full outline to the position substantially aligned with the central axis shown in dashed outline 22'.

Figure 5:
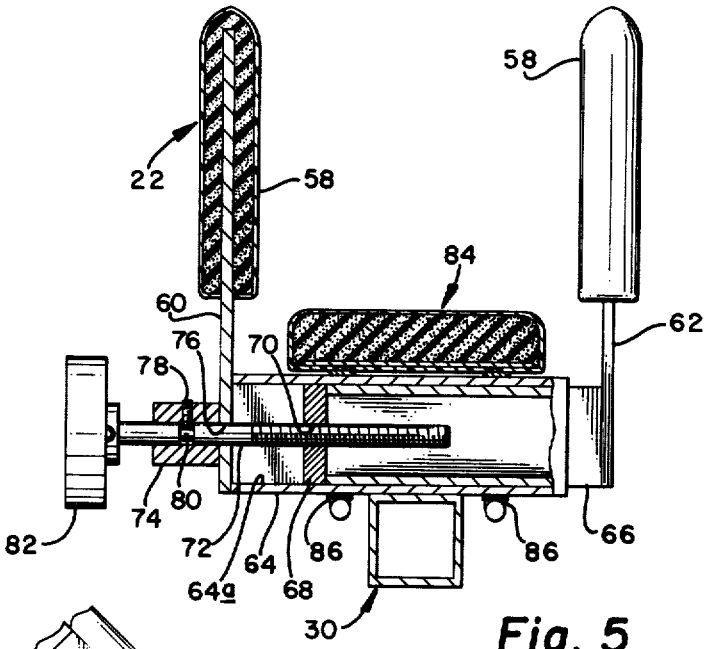
FIG. 5 is a cross-sectional view taken along line 5—5 of FIG. 4.
Figure 6:
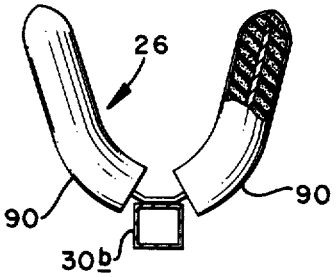
FIG. 6 is a cross-sectional view taken along line 6—6 of FIG. 4.
Figure 7:
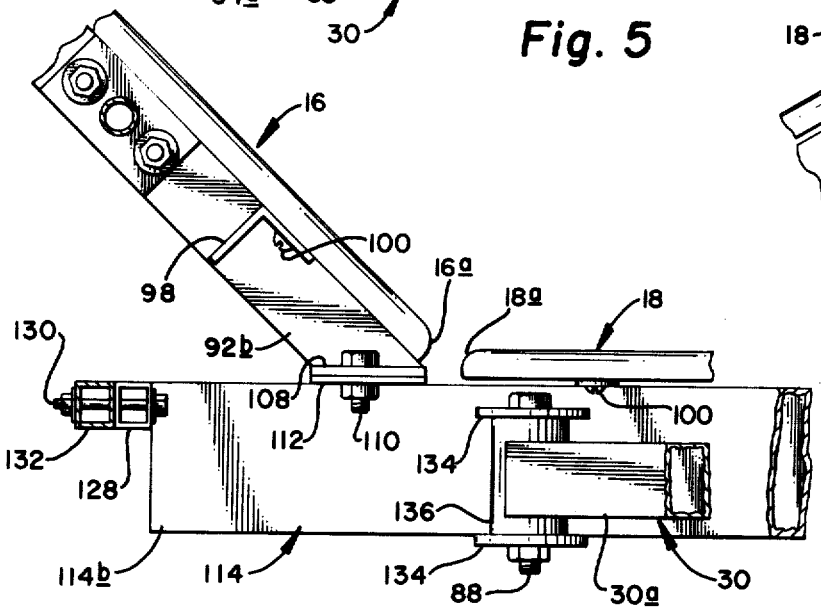
FIG. 7 is a cross-sectional view taken along line 7—7 of FIG. 4.
Figure 8:
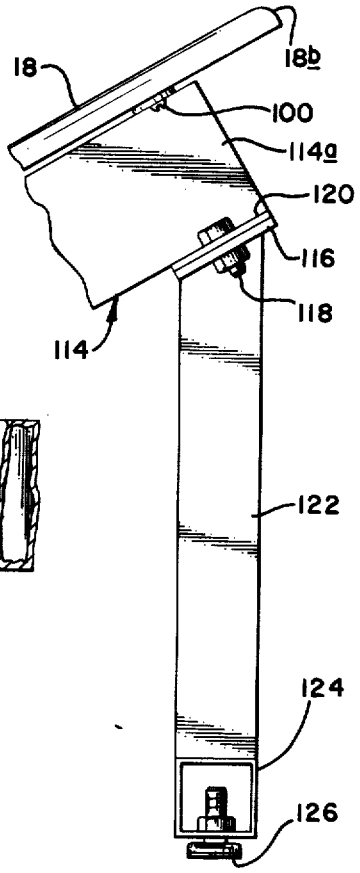
FIG. 8 is a cross-sectional view taken along line 8—8 of FIG. 4.

As best illustrated in FIG. 5, the leg pads 20 and 22 comprise generally U-shaped members having spaced vertically extending thigh pads 58 adapted to engage the thigh of the leg just above the knee. The spaced thigh pads 58 are supported by vertically extending arms 60 and 62. Means to adjust the spacing between the thigh 58 comprises a substantially rectangular shaped tubular member 64 rigidly secured to vertically extending arms 60 and a substantially rectangular member 66 rigidly secured to vertically extending arms 62 having a smaller cross-sectional area such that it is slideably disposed within the bore 64*a* of member 64. An end plate 68 is rigidly secured to member 66 having a threaded passage 70 formed centrally therein. Means to move tubular member 66 and vertically extending arm 62 outwardly from arm 60 comprises a threaded screw 72 threadedly secured through passage 70 and rotatably disposed through a bushing 74 which is rigidly secured to the exterior of arms 60 such that the threaded screw 72 extends through passage 76 formed in the arm 60. A set screw 78 is threadedly secured to a passage formed in bushing 74 and engages a groove 80 formed in screw 72. A handle 82 is rigidly secured to end thereof for rotating screw 72.

Transversely extending tubular member 64 is rigidly secured to leg support member 28 by welding or the like. A leg support cushion 84 is secured to tubular member 64 by straps 86.

Leg support members 28 and 30 generally comprise tubular members having a substantially rectangular cross-section, said members having a first end 28*a* and 30*a* pivotally secured by bolts 88 to the frame 12. As illustrated in the preferred embodiment, the second end 28*b* and 30*b* of leg supports 28 and 30 are deflected such that the leg of the user is supported in a slightly bent position.

The ankle pads 24 and 26 are rigidly secured to the ends 28*b* and 30*b* of leg support members 28 and 30 and comprise substantially U-shaped members having a cushion pad 90 positioned thereon adapted to receive force from the ankle of the user.

From the foregoing it should be readily apparent that by exerting pressure at the knee of the user against the thigh pads 58 that the leg pads 20 and 22 will be moved outwardly from the position shown in dashed outline 22' to a position spaced from the central axis A of frame 12 shown in full outline 22 and such movement will be resisted by the fluid resistant means 32.

Body support members 16 and 18 comprise substantially flat cushioned members each having lower ends 16*a* and 18*a* and upper ends 16*b* and 18*b*. The lower ends 16*a* and 18*a* of the body support members 16 and 18 are positioned adjacent one another such that the upper ends 16*b* and 18*b* extend outwardly from one another such that the angle between the upper surfaces of body support members 16 and 18 is substantially perpendicular or greater. This places the body in the reclining position with the legs in a slightly bent position which is substantially the same position that the user would be in when he is poised to work. It should be readily apparent that when the human body is positioned to do work, whether it be athletic or another type of physical endeavor, that the legs are in a slightly bent position to aid the back in lifting and the torso of the body is leaned slightly forward such that there is slight angle between the torso and the upper portion of the legs, commonly known as the thighs. Therefore, the angle between the upper surfaces of support members 16 and 18 is preferably an angle greater than 90 degrees and would be obtuse to support the body in this position and ends 28*b* and 30*b* are therefore deflected downwardly slightly to bend the knees. However, it should be readily apparent that other positions may accomplish the same results.

Figure 1:
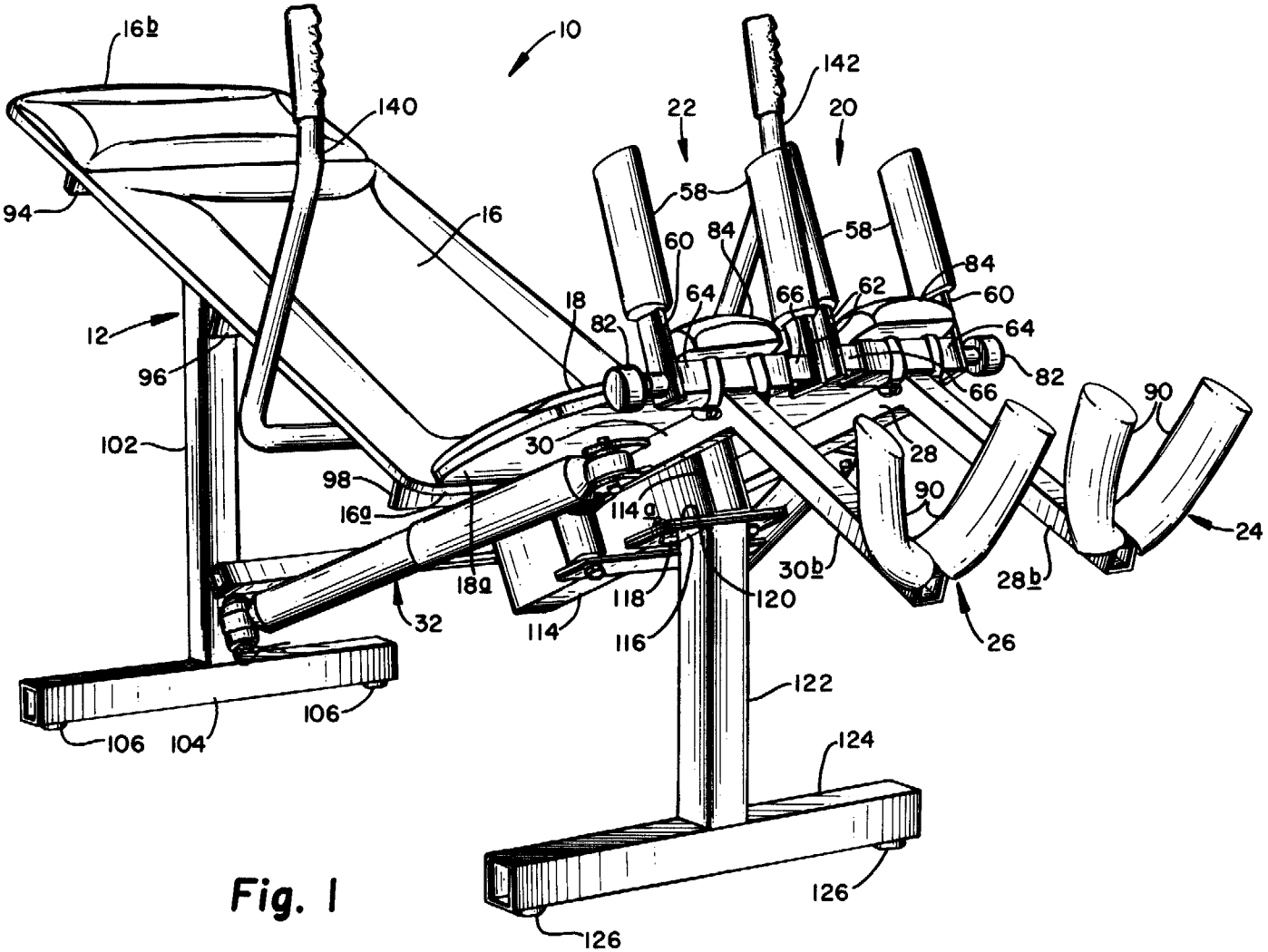
FIG. 1 is a front elevational perspective view of the leg exerciser.
Figure 2:
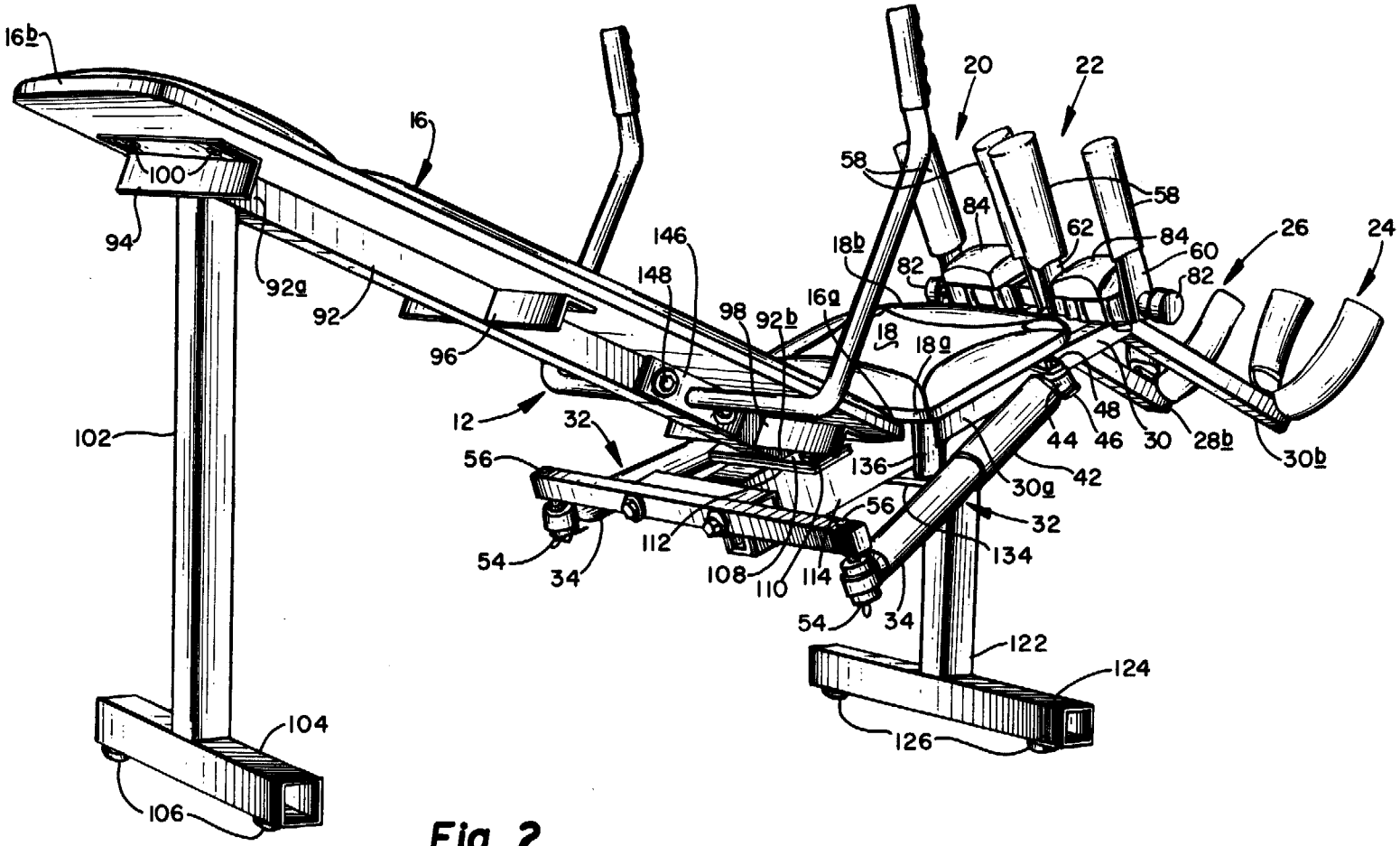
FIG. 2 is a rear elevational perspective view thereof.

The body support members 16 and 18, as best illustrated in FIG. 2, are supported by the frame 12 which is constructed of substantially rectangular shaped tubular steel. Frame 12 generally comprises an upper center member 92 substantially aligned along the central axis A of the frame 12. Spaced angles 94, 96, and 98 are welded or otherwise secured to center member 92 and secured to the body support member 16 by screws 100.

The upper end 92*a* of center member 92 is connected to leg 102 which has a horizontal member 104 secured thereto for balancing the leg exercising device 10. Feet 106 are provided to prevent scarring of the floor and prevent skiding of the device. The lower end 92*b* of center member 92 is welded or otherwise secured to a transversely secured attaching flange 108 which is secured by fastening members 110 such as bolts to a transversely secured attaching flange 112 which is rigidly secured to the lower center member 114. End 114*a* of lower center member 114 is secured to attaching flange 116 by welding or the like which is secured by bolts 118 to lower attaching flange 120 which is rigidly secured to leg 122. Leg 122 has a horizontal support member 124 having feet 126 secured thereto.

The other end 114*b* of lower center member 114 is secured to a transversely positioned cross-bar 128 secured by bolts 130 to cross-bar 132. The cross-bar 132 provides the anchor means for the end of cylinder 34 through which pin 56 is secured. Spaced cross support members 134 are secured to the lower center member 114 and adapted to receive bushings 136 secured to the ends of leg support members 28 and 30 through which bolts 88 are secured to pivotally secure the end 28*a* and 30*a* of leg support members 28 and 30.

Hand grip bars 140 and 142 extend upwardly from the frame 12 on opposite sides of the body support member 16. Hand grip bars 140 and 142 are rigidly secured to upper center member 92 of frame 12 by flange 146 secured thereto by bolt 148. The hand grip bars 140 and 142 aid in reducing upper body movement.

Operation of the hereinbefore described invention is as follows:

The user positions his body on the leg exercising device 10 such that his back rests against the upper body support member 16 and his hip rests on the lower body support member 18 with his legs extending outwardly through the leg support members 28 and 30. The user adjusts the width between the thigh pads 58 of leg pads 20 and 22 by turning knob 82 to firmly grip the thigh just above the knee.

In exercising the abduction and adduction muscles of the hip and upper leg, the user exerts pressure with his leg just above the knee against the thigh pads 58 of leg pads 20 and 22 on leg support members 28 and 30. The user continues to exert pressure against the thigh pads moving the leg pads 20 and 22 and leg support member 28 and 30 from a position shown in dashed outline 22' in FIG. 4 adjacent the central axis A of the frame 12 to a position outwardly therefrom shown in full outline. As this movement is resisted by the fluid flow resistant means 32, the muscles are stressed throughout the movement of the limb outwardly from the median axis of the body.

Movement of leg pads 20 and 22 is resisted from the position shown in full outline, in FIG. 4, spaced from the central axis A of the frame 12 of the position adjacent the central axis A of the frame 12 shown in dashed outline 22' such that the muscles which pull the leg inwardly are stressed throughout movement toward the median axis of the body.

It may be desirable to use a fluid flow resistant means 32 which has a variable valve within to adjust the force necessary to move the fluid from one end of the chamber 52 to the other end of the chamber.

By applying pressure against the ankle pads 24 and 26 with the ankle, the medial and lateral hamstring muscles are stressed such that they are strengthened.

In addition, the leg pads 20 and 22 may be locked into position by a pin (not shown) for performing isometric exercises on the legs.

It should be readily apparent that the device stresses the muscles of the legs throughout movement in a lateral direction from the median axis of the body which corresponds to the central axis A of the frame 12 to a position away from the central axis A and back again.

From the foregoing it should be readily apparent that the embodiment hereinbefore described accomplishes the objects of the invention hereinbefore discussed.

It should be appreciated that other and further embodiments of the invention may be devised without departing from the basic concept thereof.

Having described my invention, I claim:

1. An exercising device adapted to strengthen abduction and adduction muscles comprising: a frame having a central axis; leg support means pivotally secured to said frame and extending outwardly from one end of said frame; leg engaging means secured to said leg support means; body support means on said frame adapted to support a human body such that the median axis of the human body is parallel to the central axis of said frame; and fluid flow resistance means secured between said leg support means and said frame resisting movement of said leg support means in a generally horizontal direction from the sides of the body between a first position wherein the leg support means are adjacent said central axis of the frame, and a second position wherein the extremities of the leg support means are spaced from said central axis of the frame.

2. The combination called for in claim 1 with the addition of: a hand grip bar secured to said frame adapted to reduce upper body motion.

3. The combination called for in claim 1 wherein the fluid flow resistance means secured between said leg support means and said frame resisting movement of the leg support means in a generally horizontal direction comprises: a cylinder having a chamber therein; a piston; connector means connecting said leg support means to said piston; and means for controlling the flow of fluid from one end of the chamber to the other end of the chamber on opposite sides of the piston to resist movement of said piston in said chamber.

4. An exercising device adapted to strengthen abduction and adduction muscles comprising: body support means having a central axis adapted to support a human body such that the median axis of the body is substantially parallel to the central axis of the body support means; a leg pad adapted to engage the side of the leg of the user; a cylinder having a chamber formed therein; means pivotally securing one end of said cylinder to the body support means; a piston slideably disposed in said chamber; a connector means extending out of the other end of said cylinder; means securing said connector means between the piston and the leg pad; fluid disposed in said chamber; and means controlling the flow of fluid into and out of said chamber, such that the movement of the piston in said chamber is resisted and movement of the leg is resisted as the leg is moved to the side in a generally horizontally direction toward and away from the median axis of the human body.

5. The combination called for in claim 4 with the addition of: a second leg pad adapted to engage the side of the leg of the user; a second cylinder having a chamber formed therein, said second cylinder having one end pivotally secured to said support means; a piston slideably disposed in said chamber; a connector means extending out of the upper end of said cylinder, said connector means secured between the piston and the second leg pad; fluid disposed in said chamber; means controlling the flow of fluid into and out of said chamber, such that the movement of the piston within said chamber is resisted and movement of the second leg pad is resisted in a generally horizontally direction.

6. The combination called for in claim 4 wherein the support means comprises: the frame having a central axis; and body support means on said frame adapted to support the human body such that the median axis of the human body is parallel to the central axis of the frame.

7. The combination called for in claim 4 wherein the means controlling the flow of fluid into and out of said chamber comprises a pair of check valves in said piston such that movement of the fluid is resisted from the first end of the chamber on one side of the piston to the second end of the chamber on the other side of the piston and back again as the fluid moves through the check valves.

8. An exercising device adapted to strengthen abduction and adduction muscles comprising: a frame having a central axis; a pair of leg pads; means moveably securing said leg pads to said frame; body support means on said frame adapted to support a human body such that the median axis of the human body is parallel to the central axis of said frame; and fluid flow resistance means secured between said leg pads and said frame resisting movement of said leg pads in a generally horizontal direction from the sides of the body between a first position wherein the leg pads are substantially parallel to said central axis of the frame, and a second position wherein the extremities of the leg pads are spaced from said central axis of the frame, said body support means comprising: a back portion having an upper end and a lower end; a seat portion having an upper end and a lower end; means securing said back portion and said seat portion to said frame such that the lower end of said back portion is adjacent the lower end of said seat portion wherein the angle between the upper surfaces of said back portion and seat portion is obtuse.

9. An exercising device adapted to strengthen abduction and adduction muscles comprising: a frame having a central axis; a pair of leg pads; means moveably securing said leg pads to said frame; ankle pads; means securing said ankle pads to said means moveably securing said leg pads to said frame; body support means on said frame adapted to support a human body such that the median axis of the human body is parallel to the central axis of said frame; and fluid flow resistance means secured between said leg pads and said frame resisting movement of said leg pads in a generally horizontal direction from the sides of the body between a first position wherein the leg pads are substantially parallel to said central axis of the frame, and a second position wherein the extremities of the leg pads are spaced from said central axis of the frame.

10. An exercising device adapted to strengthen abduction and adduction muscles comprising: a frame having a central axis; a pair of vertically extending arms; leg pads on said vertically extending arms; means to adjust the spacing between the vertically extending arms body support means on said frame adapted to support a human body such that the median axis of the human body is parallel to the central axis of said frame; and fluid flow resistance means secured between said leg pads and said frame resisting movement of said leg pads in a generally horizontal direction from the sides of the body between a first position wherein the leg pads are substantially parallel to said central axis of the frame, and a second position wherein the extremities of the leg pads are spaced from said central axis of the frame.

11. An exercising device to strengthen abduction and adduction muscles comprising: a frame; a back on said frame, said back being inclined; a seat on said frame, said seat being inclined; a pair of leg support members; pivot means securing said leg support members to said frame such that said leg support members extend outwardly from an end of the frame; ankle engaging means adjacent outer extremities of said leg support members; leg engaging means secured to said leg support members between said ankle engaging means and said pivot means; fluid flow resistance means to resist movement of the support members; and means securing said fluid flow resistance means to permit said fluid flow resistance means to resist movement of extremities of the leg support members in at least two generally horizontal directions.

* * * * *